US008801020B2

(12) United States Patent
Borisoff

(10) Patent No.: US 8,801,020 B2
(45) Date of Patent: Aug. 12, 2014

(54) WHEELCHAIR AND FRAME FOR A WHEELCHAIR

(71) Applicant: Jaimie Borisoff, Vancouver (CA)

(72) Inventor: Jaimie Borisoff, Vancouver (CA)

( * ) Notice: Subject to any disclaimer, the term of this patent is extended or adjusted under 35 U.S.C. 154(b) by 0 days.

(21) Appl. No.: 13/890,419

(22) Filed: May 9, 2013

(65) Prior Publication Data

US 2013/0300083 A1 Nov. 14, 2013

Related U.S. Application Data

(60) Provisional application No. 61/645,468, filed on May 10, 2012.

(30) Foreign Application Priority Data

May 10, 2012 (CA) ..... 2776658

(51) Int. Cl.
*A61G 5/10* (2006.01)

(52) U.S. Cl.
CPC ..... *A61G 5/10* (2013.01)
USPC ..... 280/250.1; 280/47.38; 280/47.4

(58) Field of Classification Search
CPC ..... A61G 5/08; A61G 5/10
USPC ..... 280/250.1, 47.38, 47.4; 297/DIG. 4
See application file for complete search history.

(56) References Cited

U.S. PATENT DOCUMENTS 4,545,593 A * 10/1985 Farnam ..... 280/250.1
4,592,570 A * 6/1986 Nassiri ..... 280/650
4,598,921 A * 7/1986 Fenwick ..... 280/250.1
4,650,201 A 3/1987 Hartwell
4,861,056 A 8/1989 Duffy, Jr. et al.
4,893,827 A * 1/1990 Gay et al. ..... 280/250.1
5,143,391 A * 9/1992 Robertson et al. ..... 280/250.1
5,152,543 A * 10/1992 Sims et al. ..... 280/250.1
5,267,745 A * 12/1993 Robertson et al. ..... 280/250.1
5,382,036 A * 1/1995 Counts et al. ..... 280/250.1
5,409,247 A * 4/1995 Robertson et al. ..... 280/250.1
5,421,598 A * 6/1995 Robertson et al. ..... 280/250.1
5,556,121 A * 9/1996 Pillot ..... 280/304.1
5,573,260 A * 11/1996 Peterson et al. ..... 280/250.1
5,590,893 A * 1/1997 Robinson et al. ..... 280/250.1
5,884,928 A * 3/1999 Papac ..... 280/250.1
6,311,999 B1 * 11/2001 Kueschall ..... 280/250.1
6,419,253 B1 * 7/2002 Mascari ..... 280/250.1
7,845,665 B2 12/2010 Borisoff
7,896,385 B2 * 3/2011 Every ..... 280/650
7,988,172 B2 * 8/2011 Richter et al. ..... 280/250.1
2001/0011805 A1 * 8/2001 Kueschall ..... 280/250.1
2002/0067019 A1 * 6/2002 Brown ..... 280/250.1
2009/0146389 A1 * 6/2009 Borisoff ..... 280/250.1
2010/0038880 A1 * 2/2010 Bagg ..... 280/250.1
2014/0021694 A1 * 1/2014 Papi et al. ..... 280/249

* cited by examiner

*Primary Examiner* — Joseph M Rocca
*Assistant Examiner* — Gabriela C Craciun
(74) *Attorney, Agent, or Firm* — Smiths IP

(57) ABSTRACT

A wheelchair comprising a frame, a seat assembly attached to the frame, two rear wheels attached to the frame, and at least one front wheel assembly attached to the frame. The frame defines a front face and two side faces. The front face is defined by one or more structural elements situated along a front of the frame, while the side faces are defined by two top side members and two corresponding bottom side members. The front face and the two side faces result in three non-orthogonal planes, which contribute to the strength and stiffness of the frame.

32 Claims, 14 Drawing Sheets

WHEELCHAIR AND FRAME FOR A WHEELCHAIR

CROSS-REFERENCE TO RELATED APPLICATIONS

This application claims the benefit of U.S. Provisional Application No. 61/645,468 filed May 10, 2012.

FIELD OF THE INVENTION

The invention relates to wheelchairs, and in particular, to a frame for a wheelchair.

BACKGROUND OF THE INVENTION

Wheelchairs are used to provide mobility to disabled individuals. Conventional wheelchairs comprise a generally tubular frame with a seat. A backrest may also be attached to the rear of the frame. A pair of larger wheels is mounted to the rear of the frame, while smaller, castered wheels are attached to the front of the frame. Often, the castered wheels are welded or bolted to the frame such that replacement (either permanently or temporarily) with other castered wheels is difficult. For example, larger diameter castered wheels allow for easier rolling of the wheelchair over soft terrain. However, if the castered wheels are already welded or bolted to the frame, it becomes impractical to switch the castered wheels when travel over soft terrain is expected. A footrest is also commonly provided at the front of the wheelchair.

Several types of non-folding wheelchairs currently exist, and these can be considered to be rigid wheelchairs with frames designed generally to be light and stiff for easier wheeling and more efficient rolling. One typical element of conventional rigid wheelchair frames is a transverse (tubular) member that spans the width of the frame near or at the location where the rear wheels are mounted. This transverse member may serve to provide a frame element for attachment of the rear wheels. As well, the transverse member provides a strengthening and stiffening component to the wheelchair frame structure.

More recent developments in wheelchair design have provided for the easy adjustability of various aspects of the wheelchair to suit the size and needs of the users. For example, it is sometimes desirable for the user to sit lower in the wheelchair at an increased "dump" position (i.e. where the back of the seat is lowered with respect to the front of the seat). This is especially the case when wheeling, as the user is in a more stable position and able to wheel more efficiently. On other occasions, it may be desirable to be able to elevate the seat above the normal sitting position. This may be helpful when the user needs to access countertops or shelves. Similarly, the position and angle of the backrest may also be adjusted depending on the needs of the users.

However, the mechanisms that allow for the adjustability of the seat and the backrest may physically interfere with other components in the wheelchair frame. Of particular concern is the transverse member. As this member spans the width of the frame at the location of the rear wheels and is located directly beneath the seat, this member may limit the degree of movement and adjustability of the seat. For example, U.S. Pat. No. 7,845,665 to Borisoff also discloses a wheelchair with a seat assembly that is adjustable relative to the frame. The adjustment is made using a pair of gas springs that suspend the seat assembly from below. However, the frame in Borisoff also comprises a transverse tubular member connected near the rear end of the frame. This tubular member stiffens the frame but also limits the adjustability of the seat.

U.S. Patent Publication No. 2010/0038880 to Bagg discloses a wheelchair with an adjustable seat assembly to accommodate users of different sizes. For example, the seat width, the seat height, and the angle of the seat may be adjusted in accordance with the characteristics or the size of the users. However, the front castered wheels and the footrest are permanently connected together to form a unitary front assembly, which is then attached to the front of the frame. In the event that the user wishes to exchange the castered wheels with a different set of wheels, it is necessary to replace the entire front assembly.

The present invention addresses the need for a wheelchair frame that is sufficiently strong to accommodate the weight of a user while at the same time allowing for increased range of adjustments of the components. The present invention also addresses the need for a wheelchair frame that allows for the easy interchangeability of various components of the wheelchair.

SUMMARY OF THE INVENTION

According to one aspect of the invention, there is provided a wheelchair comprising a frame, a seat assembly attached to the frame, two rear wheels attached to the frame, and two front wheel assemblies attached to the frame. The frame has a front face and two side faces and comprises one or more structural members situated along a front of the frame, with the structural members defining a front face. The front face may be not substantially perpendicular to the ground. The frame further comprises two top side members, wherein one end of each of the top side members extends from the front towards a rear of the frame. There are two corresponding bottom side members, wherein one end of each of the bottom side members extends from the front, at a location below where the top side members extend from the front, towards the rear of the frame. Each of the two side faces are defined in part by one of the top side members, one of the corresponding bottom side members, and an edge of the front face, extending from where one of the top side members extend from the front to where the one of the bottom side members extend from the front. The front face is not substantially perpendicular to either of the side faces, the side faces are not substantially parallel to one another, and the side faces are not substantially perpendicular to the ground.

In another aspect, the one or more structural elements comprise a substantially horizontal cross-member, a substantially horizontal bottom cross-member situated below the top cross-member, and two side front members, wherein the side front members extend from one end of the top cross-member to a corresponding end of the bottom cross-member. The front face is defined by the top cross-member, the bottom cross-member, and the side front members.

In yet another aspect of the invention, the top cross-member is situated forward of the bottom cross-member.

In a further aspect of the invention, the top side members extend obliquely towards the rear of the frame. The bottom side members extend obliquely towards the rear of the frame, with the bottom side members extending obliquely at an angle with a horizontal component different from that of the top side members.

In a still further aspect of the invention, another end of the each of the top side members meets with another end of the corresponding bottom side members to form two rear corner portions. The frame comprises two horizontal slots, wherein one of the slots is situated at each of the two rear corners. The rear corner portions are bent such that the rear corner portions are substantially parallel to each other. The rear wheels are attached to the frame at the slots.

In another aspect of the invention, the seat assembly is pivotably attached to the front of the frame. One or more gas springs connect the front of the frame with the seat assembly. The back rest assembly is pivotably attached to the seat assembly. A parallel assembly connects the front of the frame with the backrest assembly.

In yet another aspect of the invention, the parallel assembly comprises one or more linkages.

In still another aspect of the invention, the parallel assembly comprises one or more secondary gas springs.

In another aspect of the invention, the parallel assembly further comprises a fork.

In another aspect of the invention, the frame is of a unitary construction. The frame may be made from carbon fibre monocoque construction.

In a further aspect of the invention, the frame is of a generally tubular construction.

In another aspect of the invention, there is provided a wheelchair comprising a frame, a seat assembly attached to the frame, two rear wheels attached to the frame, and one or two front wheel assemblies attached to the frame. The front wheel assemblies each comprise a front tube, wherein one end of the front tube is attached to the frame, and a castered wheel attached to another end of the front tube. The front tube may be removably attached to the frame.

In yet another aspect of the invention, the foot rest assembly comprises a foot rest tube, wherein one end of the foot rest tube is attached to the frame, and a foot rest attached to another end of the foot rest tube. The one end of the foot rest tube may be removably attached to the frame.

According to another aspect of the invention, there is provided a frame for a wheelchair with two rear wheels, a seat assembly, and two front wheel assemblies. The frame has a front face and two side faces and comprises one or more structural members situated along a front of the frame, with the structural members defining a front face. The front face is not substantially perpendicular to the ground. The frame further comprises two top side members, wherein one end of each of the top side members extends from the front towards a rear of the frame. There are two corresponding bottom side members, wherein one end of each of the bottom side members extends from the front, at a location below where the top side members extend from the front, towards the rear of the frame. Each of the two side faces are defined in part by one of the top side members, one of the corresponding bottom side members, and an edge of the front face, extending from where one of the top side members extend from the front to where the one of the bottom side members extend from the front. The front face is not substantially perpendicular to either of the side faces, the side faces are not substantially parallel to one another, and the side faces are not substantially perpendicular to the ground.

In a further aspect of the invention, the frame further comprises a transverse horizontal member extending from one of the bottom side members to another of the bottom side members.

The foregoing was intended as a broad summary only and of only some of the aspects of the invention. It was not intended to define the limits or requirements of the invention. Other aspects of the invention will be appreciated by reference to the detailed description of the embodiments and to the claims.

BRIEF DESCRIPTION OF THE DRAWINGS

The embodiments of the invention will be described by reference to the drawings thereof in which.

DETAILED DESCRIPTION OF THE EMBODIMENTS

Figure 1:
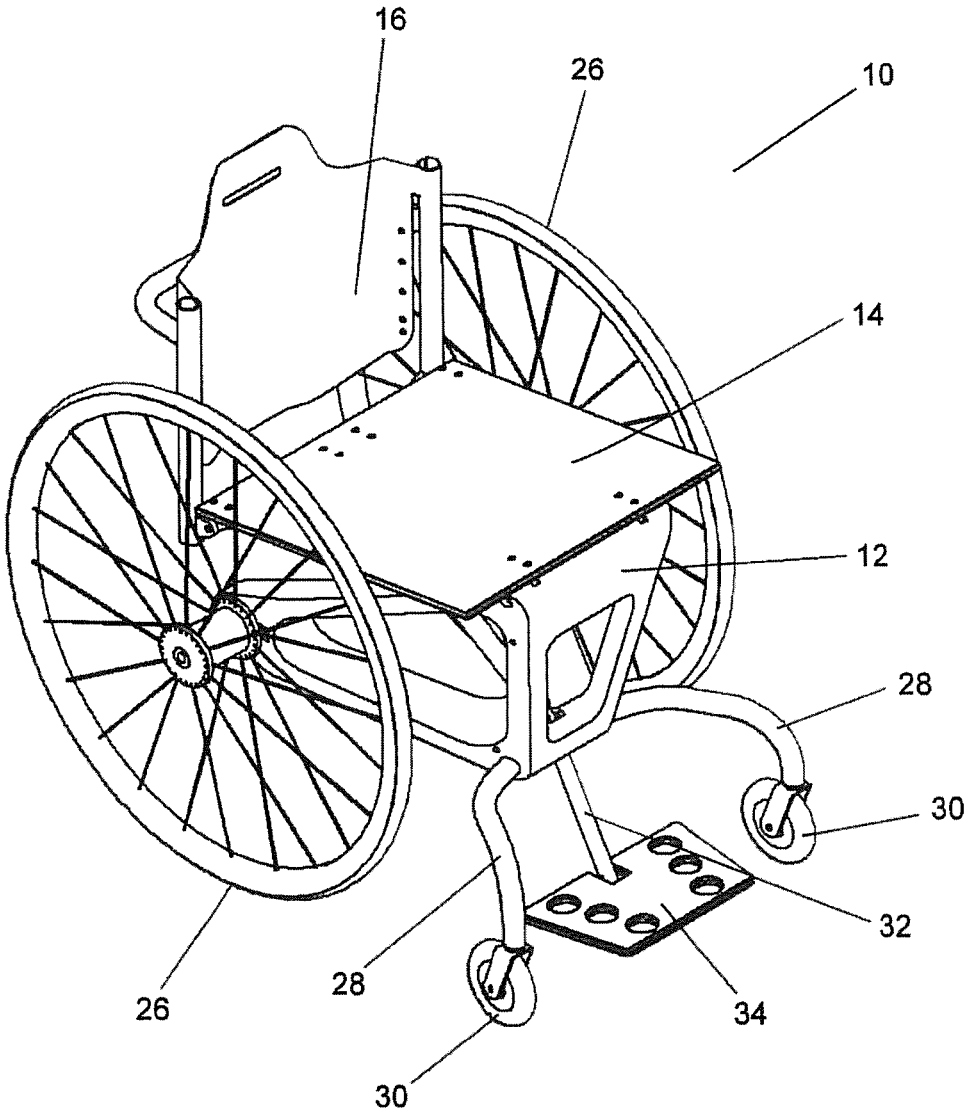
FIG. 1 is a top perspective view of the wheelchair in accordance with an embodiment of the present invention.
Figure 2:
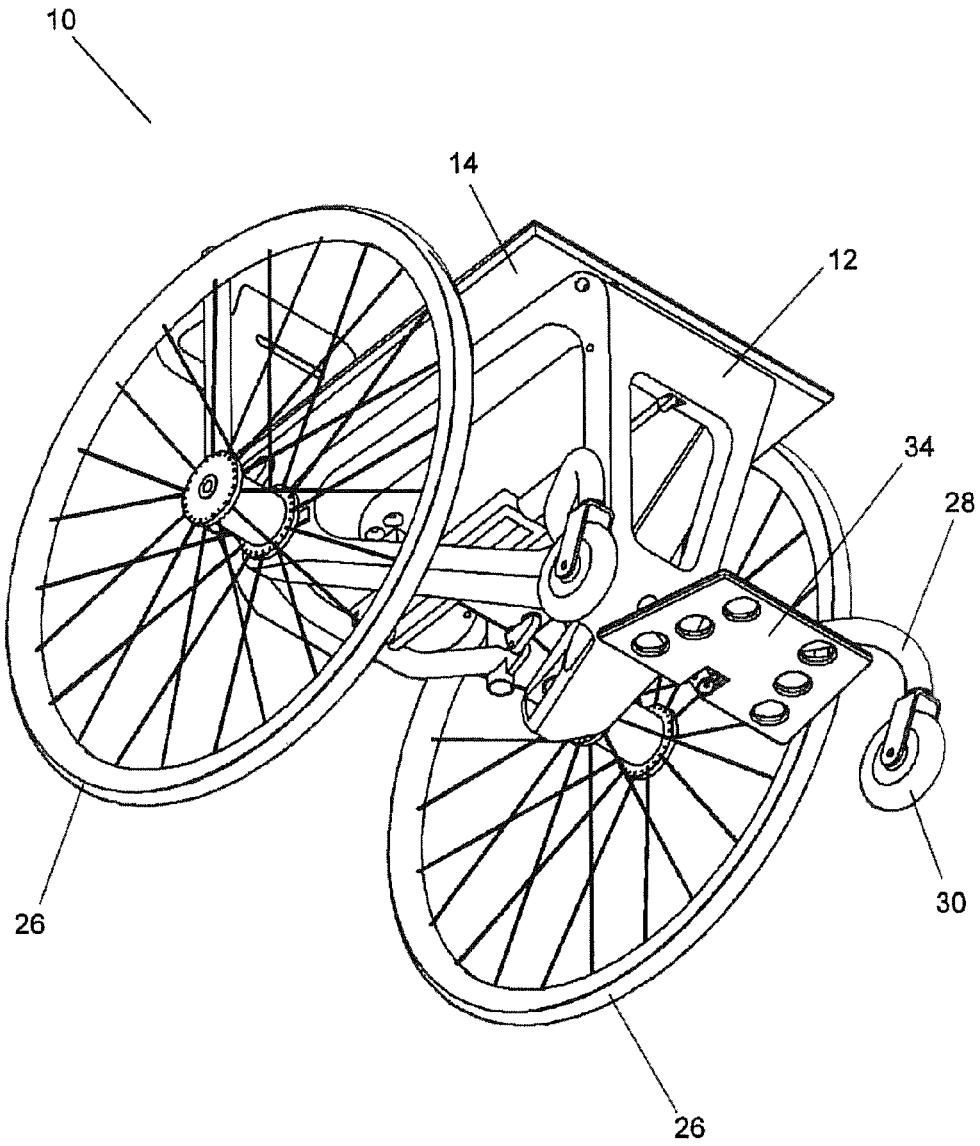
FIG. 2 is a bottom perspective view.
Figure 3:
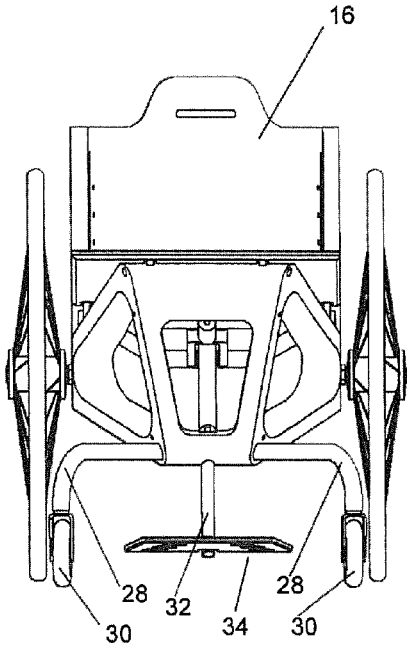
FIG. 3 is a front view of the wheelchair of FIG. 1.

Referring to FIGS. 1 to 7, in one embodiment of the invention, a wheelchair 10 is provided comprising a frame 12, a seat assembly 14, and a backrest assembly 16. The front of the seat assembly 14 is pivotably attached to the front top portion of the frame 12 at a front seat joint 18, while the rear of the seat assembly 14 is pivotably attached to the backrest assembly 16 at a rear seat joint 20. One or more gas springs 22 extend between the frame 12 and the rear of the seat assembly 14. A parallel assembly 24 extends between the frame and the bottom of the backrest assembly 16.

Rear wheels 26 extend off of the sides of the frame 12, while front tubes 28 extend from the front of the frame 12. The front tubes 28 are attached to castered wheels 30. One or more foot rest tubes 32 may also extend from the front of the frame 12, and a foot rest 34 may be attached to the foot rest tube 32.

The sides of the frame 12 define a plurality of planes, including at least one plane represented by a front face 46 of the frame and at least two planes represented by two side faces 48. The front face 46 and the side faces 48 are not necessarily solid faces but their general shapes may be defined by various structural members. The front face 46 is not substantially orthogonal to either of the two side faces 48, and the two side faces 48 are not parallel to one another. The front face 46 and the two side faces 48 form three different planes that are neither orthogonal nor parallel with respect to each other. These "three planes of non-orthogonality" formed along the sides of the frame 12 provide strength and stiffness to the structure of the frame 12.

The front face 46 may be defined by one or more structural members. FIGS. 9 to 13 show one embodiment of the frame 12. In the embodiment shown in FIGS. 9 to 13, the frame 12 comprises a generally horizontal top cross-member 36 and a generally horizontal bottom cross-member 38. Side angled members 40 extend between the ends of the top cross-member 36 and the bottom cross-member 38. In one embodiment, the top cross-member 36 is longer than the bottom cross-member 38, and therefore, the top cross-member 36, the bottom cross-member 38, and the side angled members 40 define the front face 46 as a generally trapezoidal shape, as best seen in FIG. 12. In another embodiment, the bottom cross-member 38 may be longer than the top cross-member 36. In yet another embodiment, the bottom cross-member 38 and the top cross-member 36 may be of substantially equal length (forming a generally rectangular front face 46).

Although the embodiment of the frame 12 shown in FIGS. 9 to 13 shown a frame 12 with a trapezoidal front face 46, it is not necessary that such a shape be used for the front face 46. It is possible for the front face 46 to be of different shapes, including triangular (wherein either one of the top cross-member 36 or the bottom cross-member 38 is omitted), T-shaped, sideways H-shape (with the top cross-member 36 and the bottom cross-member 38 connected by a single member), or a single vertical member.

The side faces 48 are defined by a plurality of structural members extending from the front face 46. Two top side members 42 extend from near the top of the front face 46, while two bottom side members 44 extend from near the bottom of the front face 46. The horizontal component of the angle (relative to the front face 46) at which the top side members 42 extend from the front face 46 is different than that of the two bottom side members 44 extending from the front face 46. The shape of each of the side faces 48 is defined, at least in part, by one of the top side members 42, one of the bottom side members 44, and one side of the front face 46.

Figure 4:
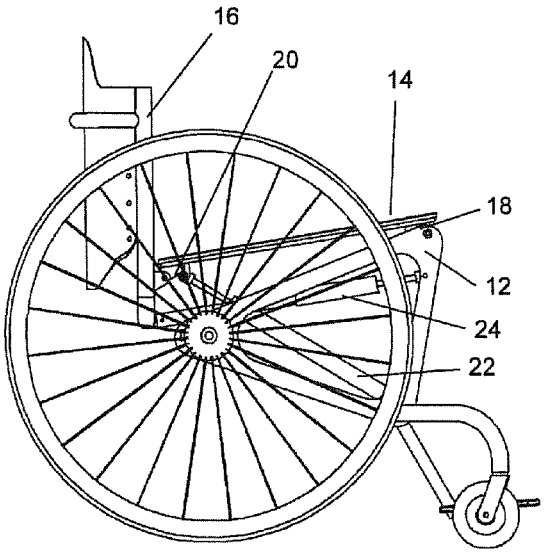
FIG. 4 is a side view of the wheelchair.
Figure 5:
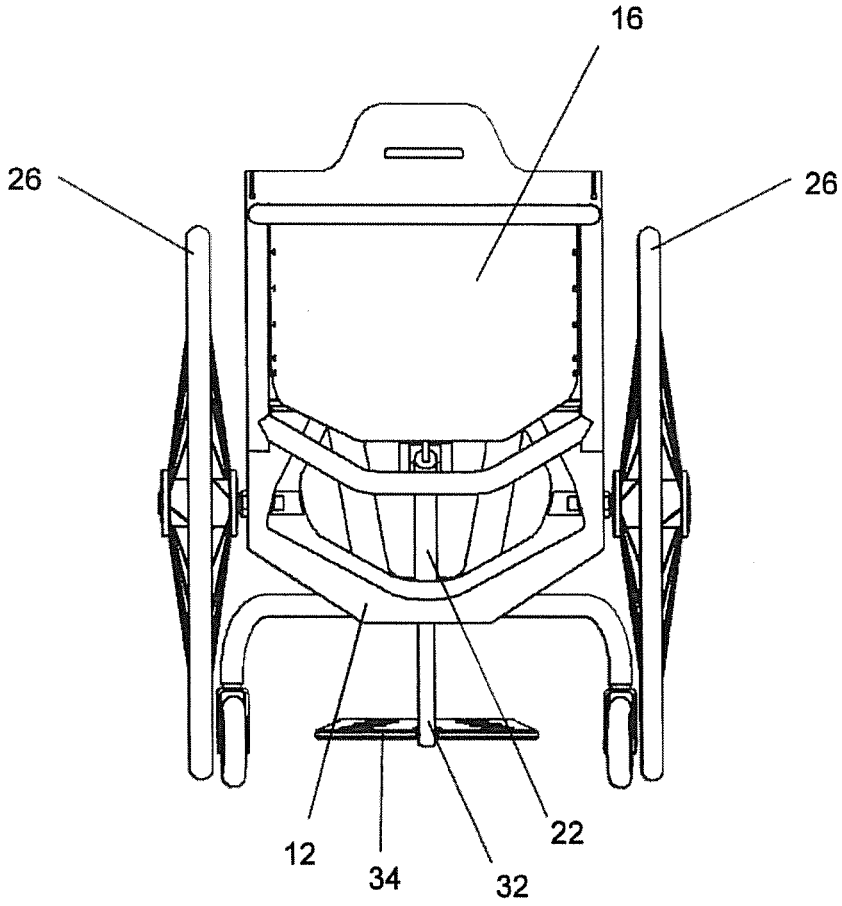
FIG. 5 is a rear view of the wheelchair.
Figure 6:
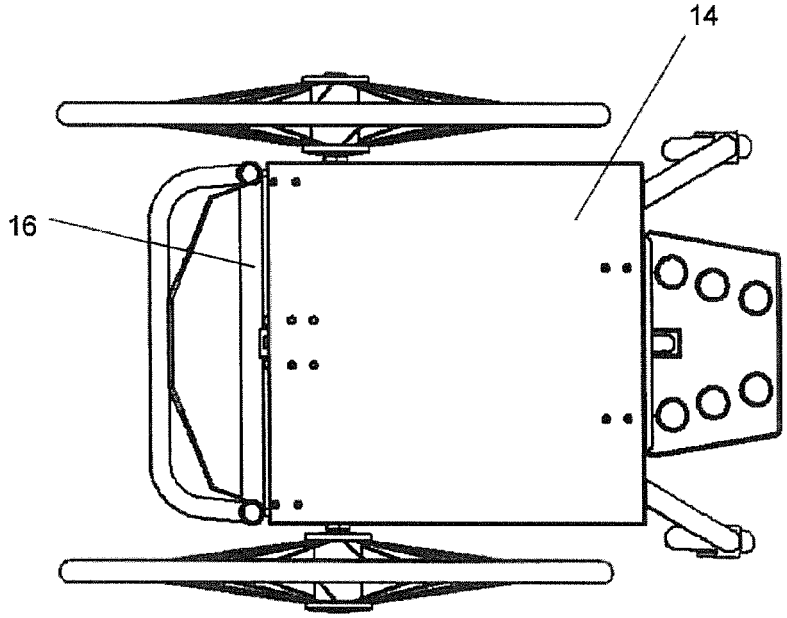
FIG. 6 is a top view of the wheelchair.
Figure 7:
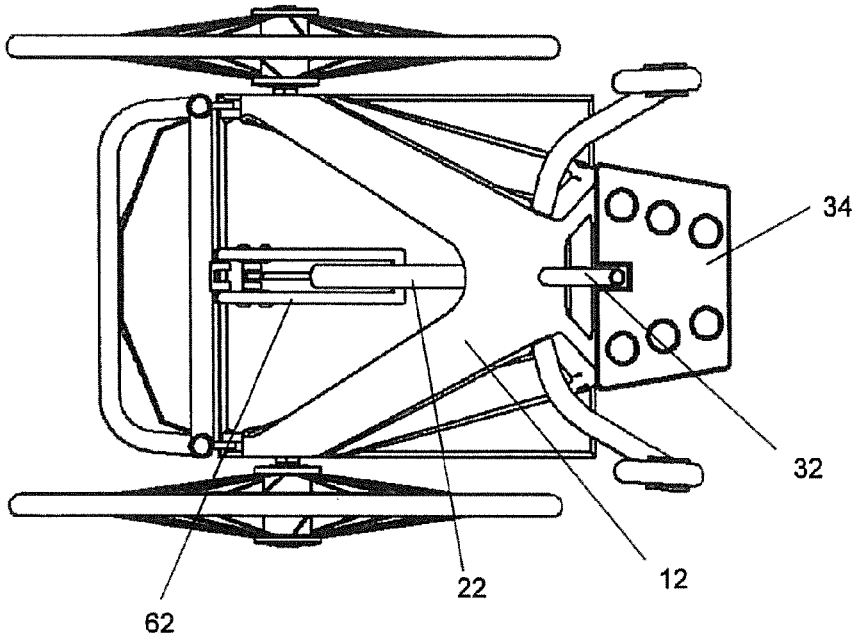
FIG. 7 is a bottom view of the wheelchair.
Figure 8:
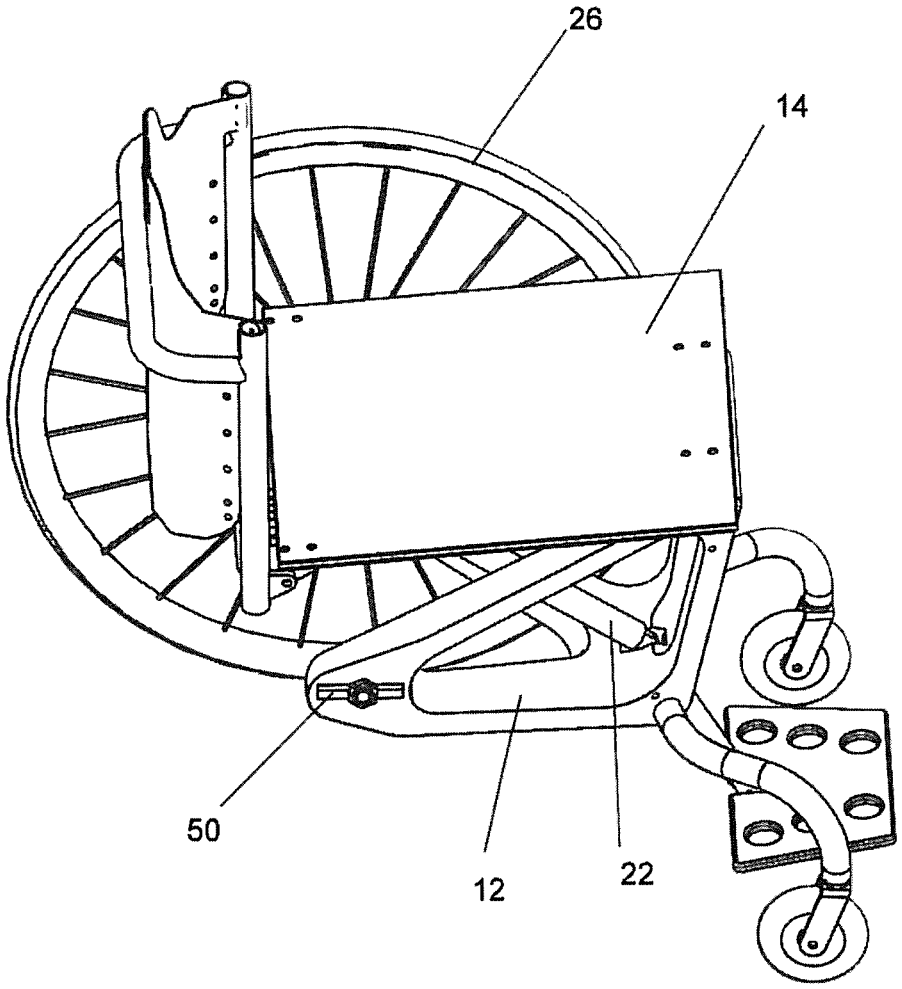
FIG. 8 is a partial top perspective view of the wheelchair, with one of the rear wheels removed.
Figure 9:
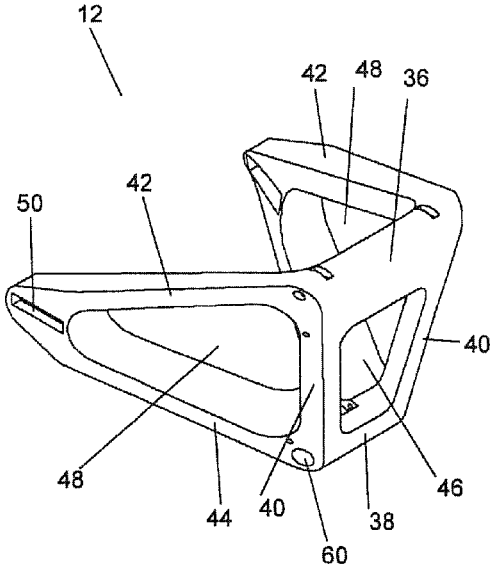
FIG. 9 is a perspective view of the frame of the wheelchair of FIG. 1.
Figure 10:
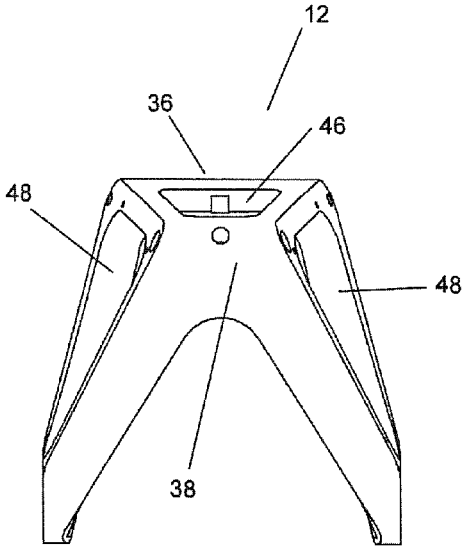
FIG. 10 is a bottom view of the frame.
Figure 11:
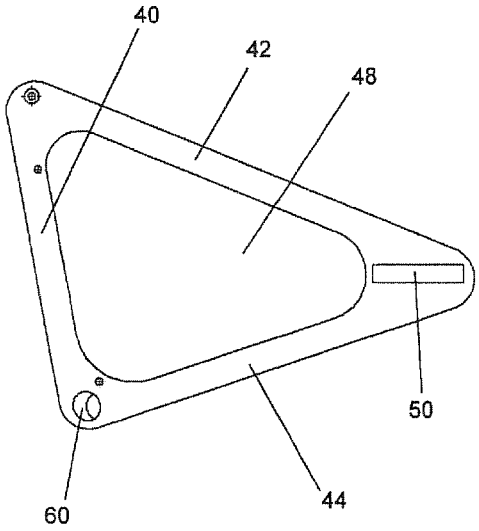
FIG. 11 is a side view of the frame.
Figure 12:
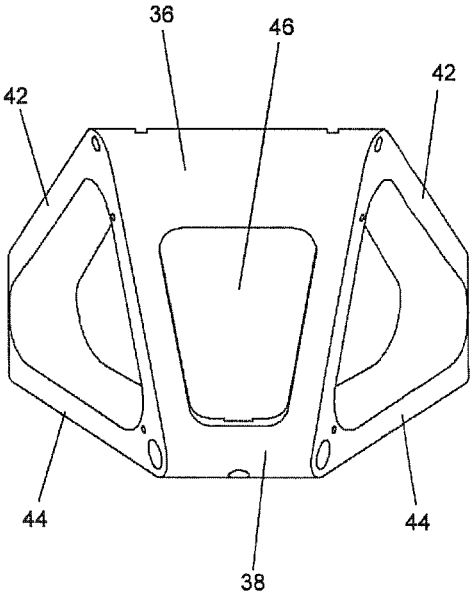
FIG. 12 is a front view of the frame.

In the embodiment of the frame 12 shown in FIGS. 9 to 13, the top side members 42 extend from the top corners of the front face 46 of the frame 12, and the bottom side members 44 extend from the bottom corners of the front face 46 of the frame 12. The ends of the top side members 42 and the bottom side members 44 meet towards the rear of the frame 12. Consequently, the top side members 42, the bottom side members 44, and the side angled members 40 define the two side faces 48 as being substantially triangular in shape, as seen best in FIG. 11. Because, as in the embodiment of FIGS. 9 to 13, the top cross-member 36 is longer than the bottom cross-member 38, the side faces 48 do not lie orthogonal to the front face 46, but instead project away from the front face 46 at an angle. It is noted that in the embodiment shown in FIGS. 9 to 13, the front face 46 itself is not oriented substantially vertical but instead, the top cross-member 36 extends forward of the bottom cross-member 38, as best seen in FIGS. 4 and 11. In one embodiment, the left and right sides of the frame 12 are symmetrical about a central vertical plane.

Figure 13:
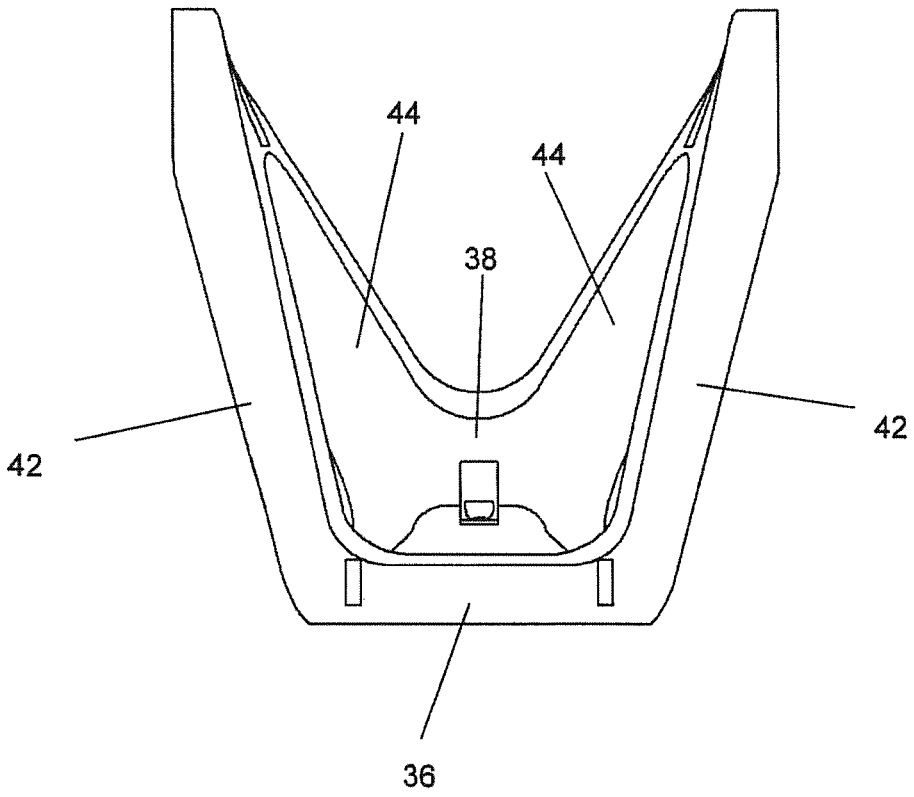
FIG. 13 is a top view of the frame.

In the embodiment of the frame 12 shown in FIGS. 9 to 13, the top side members 42 extend away from the top cross-member 36 at a particular angle, as seen in the top view of the frame 12 shown at FIG. 13. However, in comparison, the bottom side members 44 may extend away from the bottom cross-member 38 at a different horizontal angle, as seen in the bottom view of the frame 12 shown at FIG. 10. As a result, the side faces 48 lie on planes that are not perpendicular to the ground but are angled both in the horizontal and vertical directions. The side faces 48 intersect the front face 46 at an angle. The planes formed by each of the two side faces 48 and the front face 46 form the "three planes of non-orthogonality" that contribute to the strength and stiffness of the frame 12.

Horizontal slots 50 are formed at or about the intersections of the top side members 42 and the bottom side members 44. The slots 50 provide for the attachment of the rear wheels 26 to the frame 12 using various known connectors. As seen in FIGS. 10 and 13, the portions of the frame 12 at or about the intersections of the top side members 42 and the bottom side members 44 are bent such that the slots 50 run substantially parallel to one another and the rear wheels 26 may be attached to the frame 12 in a substantially vertical orientation. By providing the slots 50, easy adjustment of the fore-aft placement of the rear wheels 26 in relation to the frame 12 may be made. By changing the location of the rear wheels 26, the relationship of the rear wheels 26 and castered wheels 30 alignment may be maintained as desired. Similar slots are known in the art and are sometimes present in conventional box-frame rigid wheelchairs. It is also possible that the attachment plane containing the slots 50 is slightly angled to impart camber to the rear wheels 26. It is also possible to attach an axle insert (not shown) to the slots 50. The axle insert could further comprise an oblique through-hole for the axles of the rear wheels 26, and this would also impart camber to the rear wheels 26. Such axle inserts are known in the art. In another embodiment, instead of slots 50, simple fixed holes or receivers for attaching an axle may be present, although the fore-aft adjustment provided by the slows is now no longer possible.

The resulting overall geometry of the frame 12 comprises three planes that are neither parallel nor orthogonal to one another. This provides overall strength and stiffness to the structure of the frame 12. Furthermore, the front face 46 and the side faces 48 of the frame 12 are each comprised of edges forming non-orthogonal angles to one another (i.e. the triangular shape of the side faces 48 and the trapezoidal shape of the front face 46). This non-orthogonality of the edges of the frame 12 provides further strength and stiffness to the structure of the frame 12. Because of the additional strength and stiffness provided by the geometry of the frame 12, it is not necessary to have a transverse member extending across the rear of the frame 12. The frame 12 has sufficient strength and stiffness without the need for such a spanning member.

In one embodiment, the frame 12 is made of a single, unitary piece of material, such as from carbon fibre moncoque construction. It is also possible that the frame 12 be made from tubular members joined together, such as by welding, to form a similar configuration of non-orthogonal faces and planes. In such a case, the tubular members may be made from aluminum 6061-T6 material, although other materials such as titanium or steel may also be used.

The front of the seat assembly 14 is pivotably attached to the top cross-member 36 of the frame 12 through the front seat joint 18. One end of the gas spring 22 is attached to the bottom cross-member 36, with the other end attached to the rear of the seat assembly 14. The gas spring 22 is adjustable to allow for adjustment of the height of the rear of the seat assembly 14 relative to the frame 12. The gas spring 22 also serves as a shock absorber to cushion the user during wheelchair travel. The seat assembly is substantially flat and provides a surface for the placement of a cushion for the user to sit in the wheelchair 10 comfortably.

The gas spring 22 may be lockable or adjustable, and such springs are known in the art (such as the Varilock EL2 from Suspa Inc.). The gas spring 22 may be positioned so that cushioning occurs on the compression stroke of the gas spring 22. The gas spring 22 can be locked at any position between a fully extended position and a fully retracted position. This enables the angle of the seat assembly 14 to be adjusted.

Figure 16:
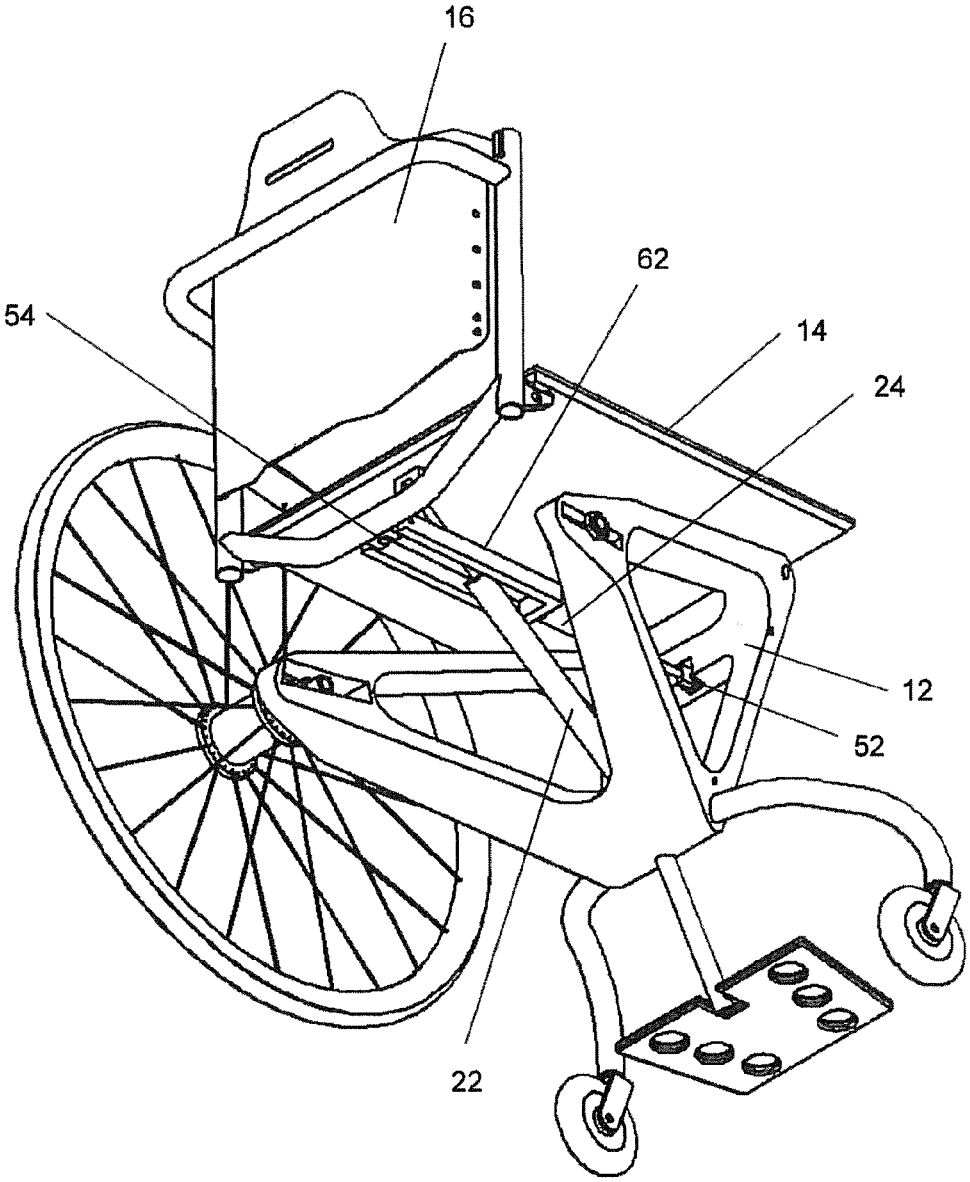
FIG. 16 is a partial bottom perspective view of the wheelchair showing a particular tilt angle for the seat, with one of the rear wheels removed.
Figure 17:
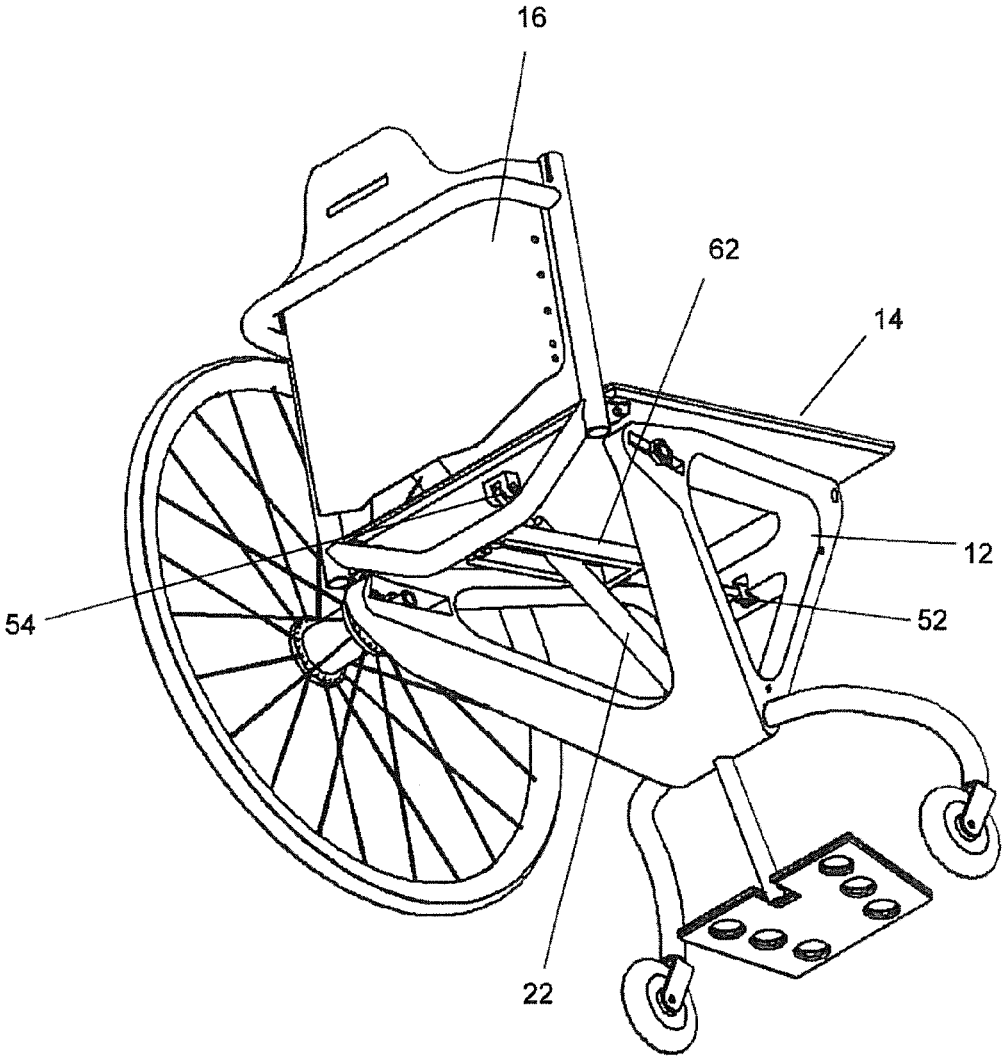
FIG. 17 is a partial bottom perspective view of the wheelchair showing a different tilt angle for the seat, with one of the rear wheels removed.

The parallel assembly 24 may comprise a linkage, such as a spring (e.g. a rigidly or elastically-locking gas spring) having a front end hingedly coupled to a front parallel hinge 52 and a rear end hingedly coupled to a rear parallel hinge 54. The front parallel hinge 52 is mounted near the top cross-member 36, and the rear parallel hinge 54 is mounted near the bottom rear of the backrest assembly 16. The parallel assembly 24 maintains the backseat assembly 16 at substantially the same angle to the frame 12 regardless of the angle of the seat assembly 14. As shown in FIGS. 16 and 17, where the wheelchair 10 comprises a single gas spring 22 and a single parallel assembly 24, the parallel assembly 24 may further comprise a fork 62 at one end of the parallel assembly 24. The fork 62 prevents the gas spring 22 and the parallel assembly 24 from interfering with each other. One mechanism for the adjustment of the seat assembly is described in U.S. Pat. No. 7,845,665 to Borisoff, the contents of which are hereby incorporated by reference.

Figure 14:
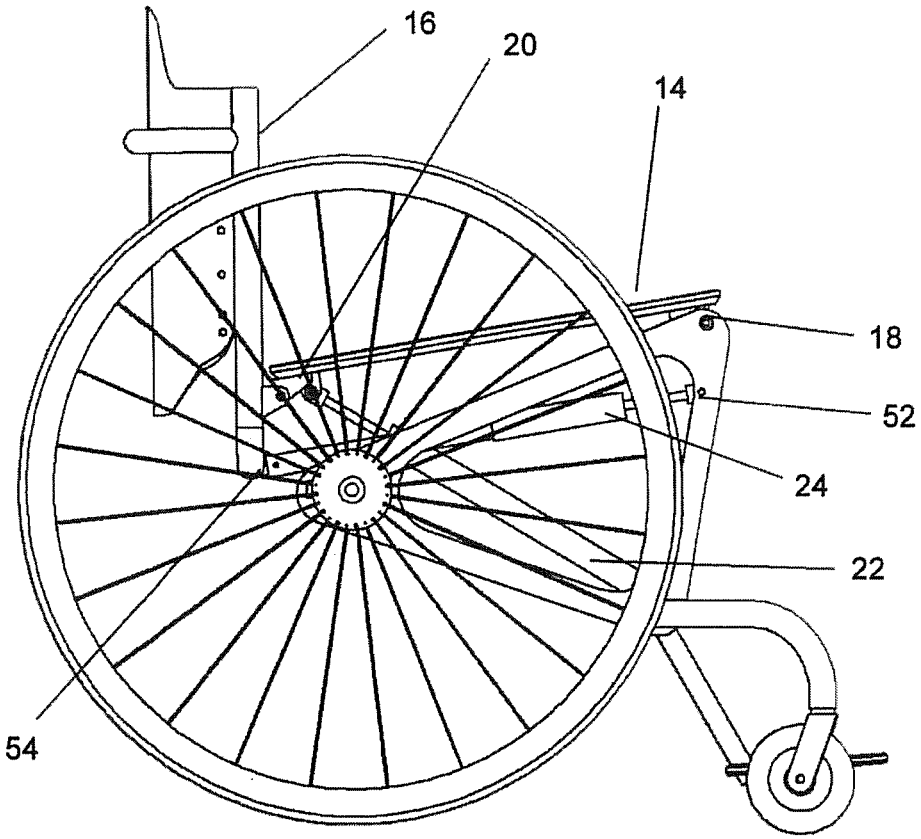
FIG. 14 is a side partial view of the wheelchair showing a particular tilt angle for the seat, with one of the rear wheels removed.
Figure 15:
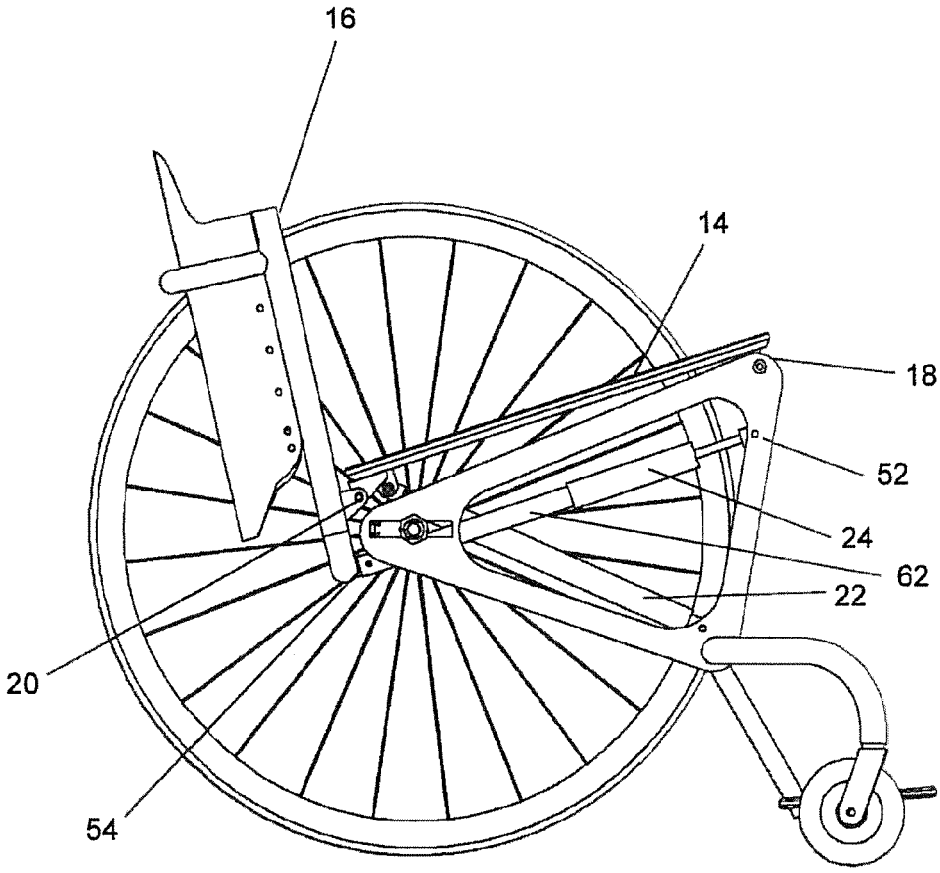
FIG. 15 is a side partial view of the wheelchair showing a different tilt angle for the seat, with one of the rear wheels removed.

The geometry of the frame 12 allows for greater adjustability of the seat assembly 14 and the backrest assembly 16 than normally allowed. Because of the plurality of the non-orthogonal planes in the frame 12 and their resulting strength and stiffness, there is no need for a transverse member. Referring to FIGS. 14 to 17, the absence of a transverse member means that there is no interference with the movements of the seat assembly 14, the parallel assembly 24, or the gas spring 22. The rear of the seat assembly 14 can be adjusted to a much lower position than would be normally possible, where the presence of the transverse member would prevent any further downward movement of the seat assembly 14. For example, as shown in FIGS. 14 and 15, if a transverse member had been present on the frame 12 around the location of where the rear wheels 26 are attached, it would have interfered with the movement of the parallel assembly 24 from the position in FIG. 14 to the position in FIG. 15.

The frame 12 also allows for a great deal of modularity. For example, different front tubes 28 (perhaps with different geometry or different castered wheels 30) can be used, depending on the needs of the user. Similarly, the rear wheels 26 may be replaced easily. For the embodiment depicted in FIGS. 1 and 2, the front tubes 28 may be constructed from round thin-wall titanium tubing, bent with two curves into the shape shown in FIG. 1. The front of each of the front tubes 28 has an insert with a threaded hole that is positioned to accept male-threaded stem axles of the forks of the castered wheels 30. The rear of each of the front tubes 28 are inserted into receptacles 60 located at the bottom of the frame 12. The front tubes 28 can be held in place with a fastener or any other suitable mechanism. Tubes with other shapes and/or female receptacles may be used (e.g. oval tubes and holes). The front tubes 28 may be made from any suitable materials, such as aluminum, steel, and carbon fibre.

Because of the modularity provided by the present invention, it is possible to quickly and easily replace one or both of the castered wheels 30. This replacement can be done independently of any replacement of the foot rest 34. Since the foot rest 34 is attached (through the foot rest tube 32) to the frame 12 separately from the castered wheels 30, any vibration or other motion experienced by the castered wheels 30 as they travel over ground is not transferred to the foot rest 34.

Figure 18:
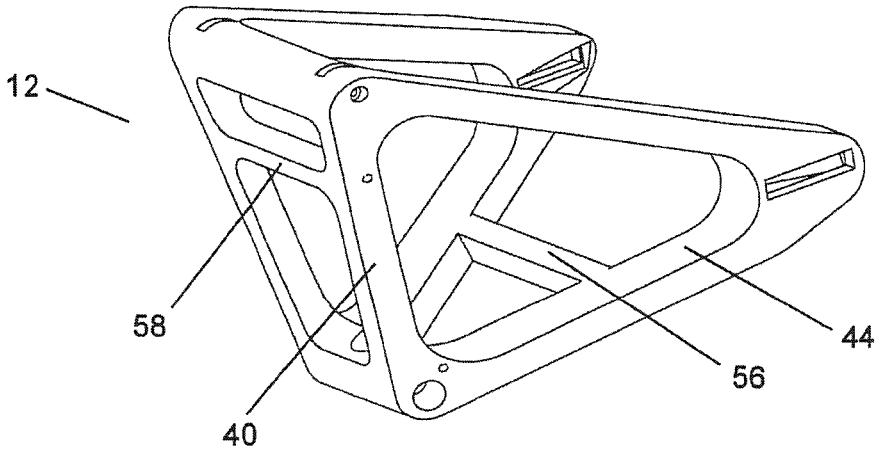
FIG. 18 shows a second embodiment of the wheelchair frame.
Figure 19:
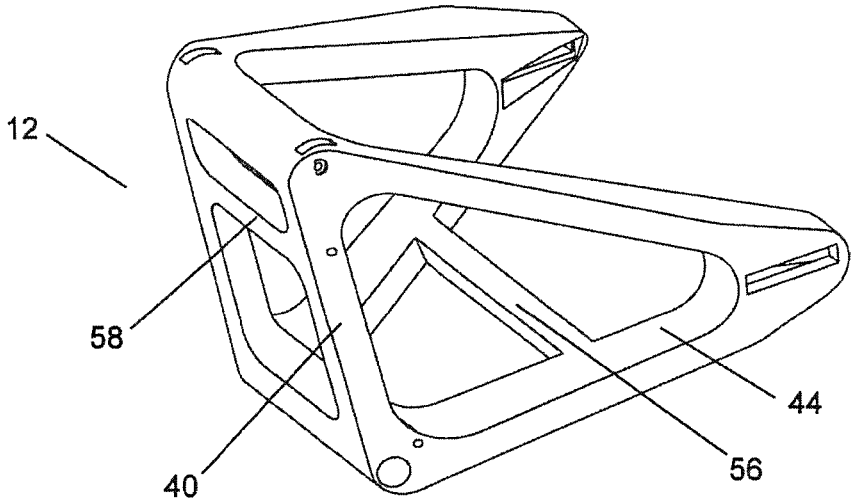
FIG. 19 shows another embodiment of the wheelchair frame.

FIGS. 18 and 19 show further possible embodiments of the frame 12. In these embodiment, the frame 12 further comprises a dorsal cross-member 56 and alternatively, a mid-front cross-member 58. The dorsal cross-member 56 is a horizontal member that spans the bottom side members 44 at a location along the lengths of the bottom side members 44. The dorsal cross-member 56 provides additional strength and stiffness to the frame 12. The mid-front cross-member 58 also provides additional strength and stiffness to the frame 12 and is a horizontal member that spans the side angled members 40 at a location along the lengths of the side angled members 40 (in between the top cross-member 36 and the bottom cross-member 38).

The addition of the dorsal cross-member 56 provides some additional design possibilities in the overall shape and configuration of the frame 12. For instance, the trapezoidal front face 46 could instead be substantially rectangular, with the resultant side faces 48, while still being non-orthogonal to the front face 46, they would now be substantially orthogonal to an imaginary horizontal plane. This results in one less plane of non-orthogonality, and the dorsal cross-member 56 provides the stiffness normally afforded by conventional transverse members located at the rear of a wheelchair frame near the rear wheel attachment location. However, the dorsal cross-member 56 is located forward of the frame 12 such that no interference with the adjustment of the seat assembly 14 occurs.

The embodiments of the invention have been described in some detail. However, those skilled in the art will appreciate that the scope of the claims should not be limited by the embodiments set forth, but should be given the broadest interpretation consistent with the description as a whole, and that modifications to the constructional details of the embodiments may be practiced within the scope of the claims. The following claims are further to be considered part of the disclosure herein.

What is claimed:

1. A wheelchair, comprising:

a frame with a front face and two side faces, said frame comprising:

one or more structural members situated along a front of said frame, said structural members defining said front face;

two top side members, wherein one end of each of said top side members extend from said front towards a rear of said frame;

two corresponding bottom side members, wherein one end of each of said bottom side members extends from said front, at a location below where said top side members extend from said front, towards said rear of said frame;

wherein each of said two side faces are defined in part by:

one of said top side members;

one of said corresponding bottom side members; and an edge of said front face, extending from where said one of said top side members extend from said front to where said one of said bottom side members extend from said front; and wherein said front face is not substantially perpendicular to either of said side faces, said side faces are not substantially parallel to one another, and said side faces are not substantially perpendicular to the ground;

a seat assembly attached to said frame;

two rear wheels attached to said frame; and at least one front wheel assembly attached to said frame.

2. The wheelchair of claim 1, wherein said one or more structural elements comprise:

a substantially horizontal top cross-member;

a substantially horizontal bottom cross-member situated below said top cross-member; and two side front members, wherein said side front members extend from one end of said top cross-member to a corresponding end of said bottom cross-member; and wherein said front face is defined by said top cross-member, said bottom cross-member, and said side front members.

3. The wheelchair of claim 2, wherein said top cross-member is longer than said bottom cross-member.

4. The wheelchair of claim 3, wherein said front face has a generally trapezoidal shape.

5. The wheelchair of claim 2, wherein said top cross-member is shorter than said bottom cross-member.

6. The wheelchair of claim 2, wherein said top cross-member is of substantially the same length as the bottom cross-member.

7. The wheelchair of claim 2, wherein said top cross-member is situated forward of said bottom cross-member.

8. The wheelchair of claim 1, wherein said top side members extend obliquely towards said rear of said frame.

9. The wheelchair of claim 8, wherein said bottom side members extend obliquely towards said rear of said frame, said bottom side members extending obliquely at an angle with a horizontal component different from that of said top side members.

10. The wheelchair of claim 1, wherein another end of each of said top side members meets with another end of corresponding said bottom side members to form two rear corner portions.

11. The wheelchair of claim 10, wherein said frame comprises two horizontal slots, wherein one of said slots is situated at each of the two rear corners.

12. The wheelchair of claim 11, wherein each of said rear corner portions are bent such that said rear corner portions are substantially parallel to each other.

13. The wheelchair of claim 12, wherein each of said rear wheels is attached to said frame at one of said slots.

14. The wheelchair of claim 13, wherein said rear wheels is removably attached to said frame.

15. The wheelchair of claim 1, wherein said seat assembly is pivotably attached to said one of said structural elements.

16. The wheelchair of claim 15 further comprising one or more gas springs connecting said structural elements and said seat assembly.

17. The wheelchair of claim 16 further comprising a back rest assembly pivotably attached to said seat assembly.

18. The wheelchair of claim 17 further comprising a parallel assembly connecting said structural elements and said backrest assembly.

19. The wheelchair of claim 18, wherein said parallel assembly comprises one or more linkages.

20. The wheelchair of claim 19, wherein said parallel assembly comprises one or more secondary gas springs.

21. The wheelchair of claim 20, wherein said parallel assembly further comprises a fork.

22. The wheelchair of claim 1, wherein said frame is of a unitary construction.

23. The wheelchair of claim 22, wherein said frame is made from carbon fibre monocoque construction.

24. The wheelchair of claim 1, wherein said frame is of a generally tubular construction.

25. The wheelchair of claim 1, wherein said front face is not substantially perpendicular to the ground.

26. A frame for a wheelchair, said frame comprising:

one or more structural members situated along a front of said frame, said structural members defining said front face, said front face being not substantially perpendicular to the ground;

two top side members, wherein one end of each of said top side members extend from said front towards a rear of said frame;

two corresponding bottom side members, wherein one end of each of said bottom side members extend from said front, at a location below where said top side members extend from said front, towards said rear of said frame;

wherein each of said two side faces are defined in part by:

one of said top side members;

one of said corresponding bottom side members; and an edge of said front face, extending from where said one of said top side members extend from said front to where said one of said bottom side members extend from said front; and wherein said front face is not substantially perpendicular to either of said side faces, said side faces are not substantially parallel to one another, and said side faces are not substantially perpendicular to the ground.

27. The frame of claim 26, wherein said one or more structural elements comprise:

a substantially horizontal top cross-member;

a substantially horizontal bottom cross-member situated below said top cross-member; and two side front members, wherein said side front members extend from one end of said top cross-member to a corresponding end of said bottom cross-member; and wherein said front face is defined by said top cross-member, said bottom cross-member, and said side front members.

28. The frame of claim 27, wherein said top cross-member is longer than said bottom cross-member.

29. The frame of claim 26, wherein said top cross-member is situated forward of said bottom cross-member.

30. The frame of claim 26, wherein said top side members extend obliquely towards said rear of said frame.

31. The frame of claim 29, wherein said bottom side members extend obliquely towards said rear of said frame, said bottom side members extending obliquely at an angle with a horizontal component different from that of said top side members.

32. The frame of claim 26, wherein said frame further comprises a transverse horizontal member extending from one of said bottom side members to another of said bottom side members.

* * * * *